US006755625B2

(12) United States Patent
Breeden

(10) Patent No.: US 6,755,625 B2
(45) Date of Patent: Jun. 29, 2004

(54) INLET THROTTLE VALVE

(76) Inventor: Robert H. Breeden, 732 Beechwood Dr., Wooster, OH (US) 44691

( * ) Notice: Subject to any disclaimer, the term of this patent is extended or adjusted under 35 U.S.C. 154(b) by 0 days.

(21) Appl. No.: 10/266,012

(22) Filed: Oct. 7, 2002

(65) Prior Publication Data

US 2004/0067143 A1 Apr. 8, 2004

(51) Int. Cl.[7] ..... F04B 49/03

(52) U.S. Cl. ..... 417/298; 417/307; 417/441; 251/63; 137/565.3; 123/446; 123/506; 123/179.17

(58) Field of Search ..... 417/298, 307, 417/440, 441; 251/63, 325; 137/565.3; 123/446, 506, 179.17

(56) References Cited

U.S. PATENT DOCUMENTS

| | | | | | |
|---|---|---|---|---|---|
| 3,065,701 | A | | 11/1962 | Bessiere | 103/41 |
| 3,772,889 | A | | 11/1973 | Mason et al. | 60/473 |
| 4,345,881 | A | | 8/1982 | Petersson et al. | 417/270 |
| 4,413,472 | A | * | 11/1983 | Lang | 60/420 |
| 4,662,825 | A | | 5/1987 | Djordjevic | 417/206 |
| 3,935,917 | A | | 6/1987 | Eley et al. | 180/53.4 |
| 4,691,526 | A | | 9/1987 | Kobayashi et al. | 62/217 |
| 4,741,675 | A | | 5/1988 | Bowden | 417/295 |
| 4,743,168 | A | | 5/1988 | Yannascoli | 417/53 |
| 4,756,330 | A | * | 7/1988 | Tischer | 137/101 |
| 4,850,815 | A | | 7/1989 | Nakajima et al. | 417/295 |
| 5,009,576 | A | | 4/1991 | Gagnet | 417/295 |
| 4,746,276 | A | | 10/1991 | McBurnett et al. | 417/295 |
| RE33,835 | E | | 3/1992 | Kime et al. | 239/657 |
| 5,129,791 | A | | 7/1992 | Nakajima | 417/295 |
| 5,133,186 | A | | 7/1992 | Weissinger | 60/464 |
| 5,156,531 | A | | 10/1992 | Schmid et al. | 417/295 |
| 5,515,829 | A | | 5/1996 | Wear et al. | 123/446 |
| 5,603,601 | A | | 2/1997 | Winkelstroter | 415/55.1 |
| 5,611,675 | A | | 3/1997 | Uchida et al. | 417/270 |
| 5,636,973 | A | | 6/1997 | Sonobe et al. | 417/222.2 |
| 5,881,698 | A | | 3/1999 | Tuckey et al. | 123/497 |
| 6,082,321 | A | * | 7/2000 | Kopec | 123/196 R |
| 6,162,022 | A | | 12/2000 | Anderson et al. | 417/213 |
| 6,170,508 | B1 | | 1/2001 | Faust et al. | 137/12 |
| 6,216,670 | B1 | | 4/2001 | Anderson et al. | 123/446 |
| 6,241,212 | B1 | * | 6/2001 | Takahashi et al. | 251/44 |
| 6,293,253 | B1 | * | 9/2001 | Arnold et al. | 123/458 |
| 6,427,663 | B1 | | 8/2002 | Breeden | 123/446 |
| 6,439,199 | B2 | | 8/2002 | Ramseyer et al. | 123/446 |
| 6,439,202 | B1 | * | 8/2002 | Carroll et al. | 123/467 |
| 6,581,577 | B1 | * | 6/2003 | Geyer | 123/514 |
| 2001/0054442 | A1 | * | 12/2001 | Voss | 137/522 |
| 2002/0034448 | A1 | | 3/2002 | De Matthaesis | 417/295 |
| 2002/0117149 | A1 | * | 8/2002 | Igashira et al. | 123/446 |
| 2002/0157643 | A1 | * | 10/2002 | Smith et al. | 123/446 |
| 2003/0089341 | A1 | * | 5/2003 | Schueler et al. | 123/458 |
| 2003/0136385 | A1 | * | 7/2003 | Dutt | 123/506 |

* cited by examiner

*Primary Examiner*—Justine R. Yu
*Assistant Examiner*—Emmanuel Sayoc
(74) *Attorney, Agent, or Firm*—Hooker & Habib, P.C.

(57) ABSTRACT

An inlet throttle valve for supplying liquid to a high-pressure pump has a fully open start position and an operating range where flow through the valve is determined by a pressure balance of a valving member independent of the pressure of oil supplied to the inlet throttle valve. The valve includes a hydraulic stop limiting closing movement of the valving member. The valve may be used to flow low-pressure oil to a high-pressure pump for supplying high-pressure oil to HEUI injectors or other components of an internal combustion engine.

33 Claims, 3 Drawing Sheets

INLET THROTTLE VALVE

FIELD OF THE INVENTION

The invention relates to valves used to throttle inlet flow of a liquid to a pump, typically a high-pressure pump used to supply high-pressure fluid to pressure-operated components of an internal combustion engine and to related methods.

DESCRIPTION OF THE PRIOR ART

Diesel engines using Hydraulic Electronic Unit Injector (HEUI) systems are well known. In these systems, low-pressure liquid, typically engine oil, is pumped to a high-pressure and used to operate electronically actuated fuel injectors. Similar hydraulic systems may be used to supply high-pressure fluid to operate electronically actuated intake and exhaust valves.

U.S. Pat. No. 6,390,072 discloses a HEUI system for a diesel engine using a high-pressure pump and a hydraulic circuit including an inlet throttle valve for throttling the flow of low-pressure engine oil to the inlet of the high-pressure pump. The inlet throttle valve is controlled in response to an injection pressure regulator (IPR) valve which supplies a hydraulic signal to the inlet throttle valve proportional to the difference between the desired output pressure of the high-pressure pump and the actual output pressure of the pump. In this system, engine oil is supplied to the inlet throttle valve from the low-pressure engine pump used to supply engine oil to bearings and cooling jets. The oil is flowed from the inlet throttle valve to the high-pressure pump. The high-pressure pump and hydraulic control system for the pump work well and represent a marked improvement over prior systems. Nonetheless, testing of the hydraulic circuit and inlet throttle valve indicates an opportunity exists to improve performance of the circuit.

The circuit can be improved during low speed or idling operation of the engine to reduce modulation of the inlet throttle valve. This modulation is believed to occur because the pressure of oil supplied to the inlet throttle valve changes significantly for different operating conditions of the engine. Oil from the low-pressure pump acts directly on one side of the inlet throttle valve spool biasing the spool in an opening direction. Variations in the bias force adversely affect stability of the system. Thus, there is a need for an improved inlet throttle valve for stable operation during low speed operation of the engine.

When a diesel engine using the prior hydraulic control system is operated at a high engine speed, and the IPR valve generates a signal to rapidly reduce output pressure a resultant rapid pressure increase in the hydraulic circuit may affect the stability of the system. The instability is believed to result from a rise in pilot pressure when the inlet throttle spool reaches the end of its travel and engages a stop. Thus, there is a need for an improved inlet throttle valve for dumping increased bleed flow to the sump.

Further, there is a need for an inlet throttle valve and control system for a high-pressure pump where the inlet throttle valve has improved rapid response to control signals.

In the conventional hydraulic control, movement of the inlet throttle spool to the closed position is limited by surface-to-surface engagement between the spool and a fixed stop surface. This engagement is believed undesirable because of possible mechanical injury to the spool at the point of engagement and because the mechanical stop occurs abruptly and may destabilize the spool.

In many internal combustion engines it is desirable to bring the engine to operating temperature rapidly and reduce combustion pollutants. Accordingly, there is a need for an improved inlet throttle valve which, at start up, is maintained in an open position to permit high flow of oil to the high-pressure pump so that energy of excess flow from the high-pressure pump is converted to heat and warms the engine.

SUMMARY OF THE INVENTION

The invention is an improved inlet throttle valve and method. The valve has a lightweight spool that is rapidly responsive to input signals. The valve includes a passage leading to the sump that is opened when the spool is moved to the closed position to direct increased bleed signal flow to the sump without disrupting operation of the IPR valve. The inlet throttle valve has a hydraulic stop limiting movement of the spool toward the closed position without mechanical engagement between the spool and a stop member.

At startup of the engine, the inlet throttle valve automatically holds the inlet throttle valve spool in a fully open start position for a period of time so that oil supplied to the inlet throttle valve from the low-pressure pump is flowed to the inlet of the high-pressure pump through a large area flow opening, substantially without obstruction. More oil is pumped by the high-pressure pump than is required to drive the injectors. Excess pressurized pump flow is throttled by valve and is returned to the sump. Since no work is being done by the oil, the temperature of the oil rises to warm the engine. This facilitates rapid warm up of the engine.

After a selected period of time, the spool automatically moves from the start up position to an open operating position to reduce the large flow opening and is in position to throttle flow to the high-pressure pump throughout its operating range, responsive to input signals from the IPR valve. During the startup period, the spool does not respond to signals received from the IPR valve.

Other objects and features of the invention will become apparent as the description proceeds, especially when taken in conjunction with the accompanying drawings illustrating the invention.

DESCRIPTION OF THE PREFERRED EMBODIMENT

U.S. Pat. No. 6,390,072 discloses an inlet throttle valve and hydraulic circuitry related to the valve and circuitry of the present invention. The disclosure of U.S. Pat. No. 6,390,072 is incorporated herein by reference, in its entirety.

Figure 1:
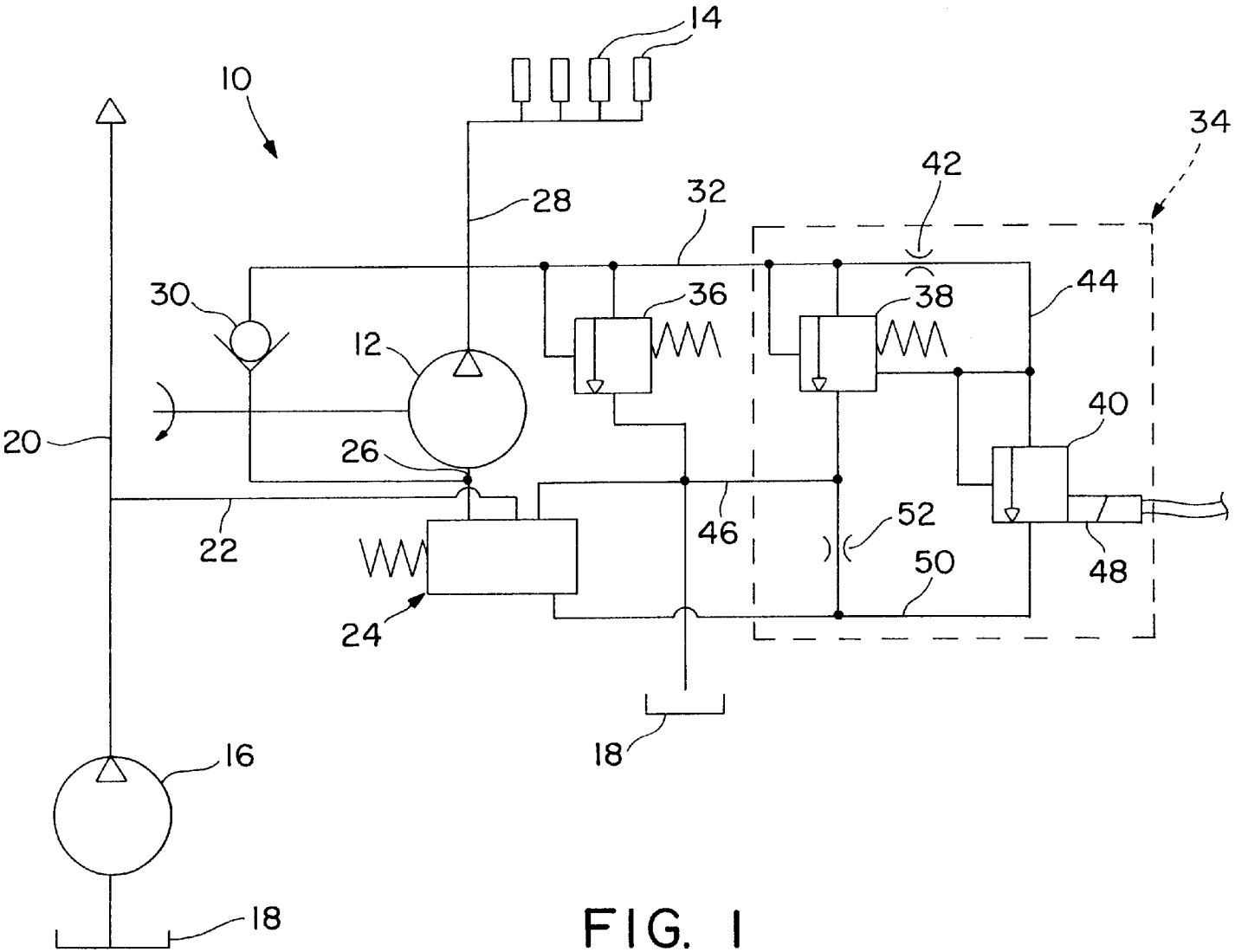
FIG. 1 illustrates a hydraulic circuit using an inlet throttle valve per the invention.

FIG. 1 illustrates a hydraulic control circuit 10 for pressurizing HEUI injectors in a diesel engine. High-pressure pump 12 is driven by the engine and flows high-pressure engine oil to a plurality of HEUI fuel injectors 14. Pump 12 may be of the type disclosed in U.S. Pat. No. 6,390,072. The circuit includes a conventional low-pressure engine lubricating oil pump 16, which flows engine oil from sump 18 through low-pressure line 20 to engine bearings and cooling jets. Pump 16 flows low-pressure engine oil to high-pressure pump 12 through inlet line 20, branch inlet line 22, inlet throttle valve 24 and pump inlet passage 26.

High-pressure pump 12 pumps oil, supplied from the inlet throttle valve at a high-pressure into high-pressure outlet passage 28 extending to injectors 14. A conventional makeup ball check valve 30 is connected between passages 26 and 28 to permit makeup oil to flow into passage 28 after shutdown of the engine.

High-pressure outlet passage 32 is connected to passage 28 and extends to two-stage injection pressure regulator (IPR) valve 34. Mechanical high-pressure relief valve 36 connects passage 32 to sump 18. The valve dumps high-pressure oil to sump 18 to limit the maximum outlet pressure in passage 28. The relief valve 36 has a high cracking pressure.

IPR valve 34 includes mechanical transient overpressure valve 38 and electrically modulated pilot stage valve 40. Restriction 42 is provided in passage 32 between valves 38 and 40 to form a reduced pressure passage portion 44 extending from the restriction to valve 40. Valve 38 is mounted between the high-pressure portion of passage 32 and passage 46 leading to sump 18. A transient overpressure in the high-pressure portion of passage 32 acting on the high-pressure side of the spool of valve 38 overcomes the force of the valve spring and reduced pressure in passage portion 44 acting on the low-pressure side of the spool to open the valve, flow oil directly to sump 18 and reduce the output pressure of pump 12 in passage 28.

Pilot stage valve 40 includes a solenoid 48 surrounding an axially moveable armature. The leads of the solenoid are connected to the electronic control module of the diesel engine for circuit 10. Current signals from the electronic control module to the solenoid move the valve armature in one direction. This movement is opposed by the pressure of oil in reduced pressure portion 44 of passage 32. Pilot flow passage 50 communicates with dump passage 46 and sump 18 through restriction 52. Passage 50 also extends to inlet throttle valve 24, as described below. Valve 40 generates a bleed flow of oil to valve 24 through passage 50 proportional to the difference between the pressure in passage 28 and the desired pressure in passage 28. Bleed flow through passage 50 is decreased to increase flow through inlet throttle valve 24 and output pressure, and is increased to decrease flow through valve 24 and output pressure. The operation of valve 40 is described in U.S. Pat. No. 6,390,072.

Inlet throttle valve 24 is illustrated in FIGS. 2–6 of the drawings. The valve is preferably located in body 54 of pump 12, although the valve may be located apart from the pump, if desired. The valve includes a cylindrical valving bore or passage 56 extending between opposed sides of body 54 with plugs 58 and 60 closing the opposed ends of the bore. A circumferential inlet port 62 surrounds and opens into bore 56 adjacent plug 60. Circumferential outlet port 64 surrounds and opens into bore 56 adjacent plug 58 and is located between the plug and port 62. Low-pressure oil inlet branch line 22 extends into body 54 and opens into inlet port 62 to flow low-pressure oil from engine oil pump 16 to port 62. The upstream end of inlet passage 26 for high-pressure pump 12 opens into outlet port 64 to flow low-pressure oil from valve 24 to pump 12 to be pumped and flowed, at high-pressure, into outlet passage 28. The volume of oil flowed to pump 12 and resultant pressure in passages 28 and 32 are controlled by valve 24.

Valve 24 includes hollow, cylindrical spool or valving member 66 having a close sliding fit in bore 56. The spool has a closed circular piston 68 at the end thereof adjacent plug 60 and a cylindrical wall 70 extending away from the piston to open end 72 adjacent plug 58.

Inlet throttle valve helical spring 74 is fitted in bore 56 with one end of the spring seated in a recess in plug 58 and the other end of the spring extending into the hollow spool and engaging piston 68. The spring biases the spool toward the fully open start position of the valve shown in FIG. 2 where the spool piston 68 engages plug 60, which serves as a stop. Pilot flow passage 50 extends into body 54 and opens into bore 56 adjacent plug 60. Hydraulic pressure of the pilot flow exerted on hydraulic pressure responsive piston 68 moves the spool from the fully open start position of FIG. 2 to operational positions shown in FIGS. 3, 4 and 5.

Figure 4:
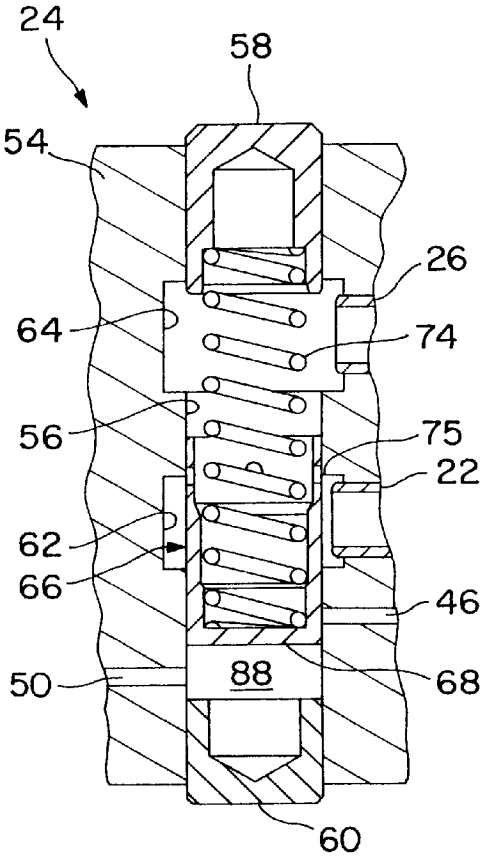
FIGS. 2, 3, 4 and 5 are sectional views of the inlet throttle valve in different positions.
Figure 3:
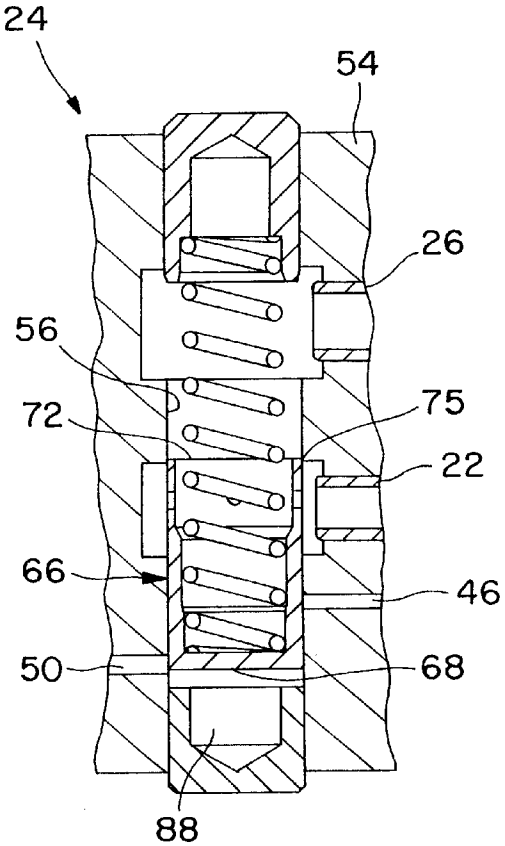
Figure 5:
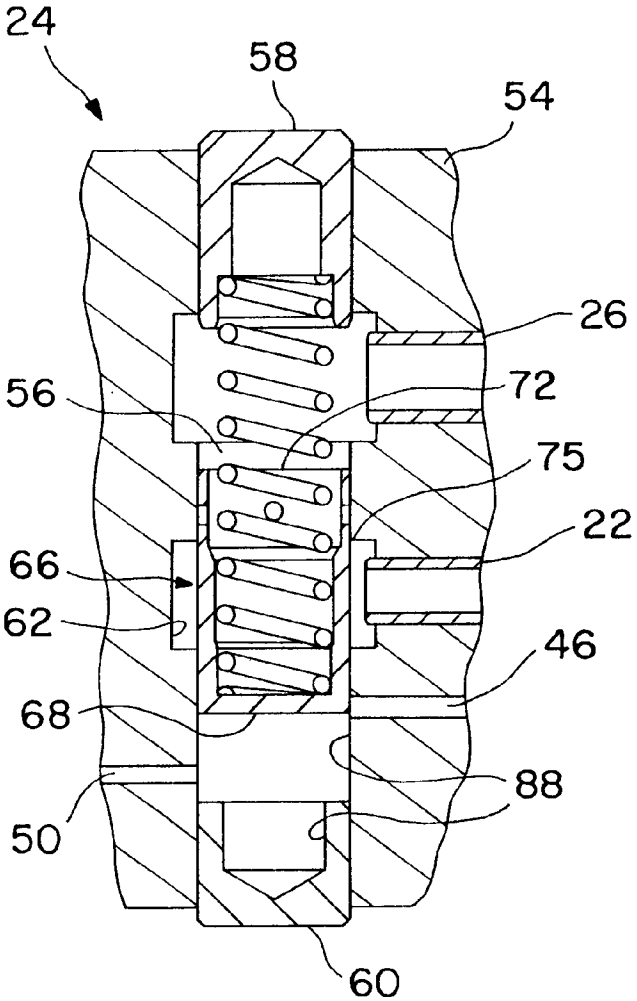

Drain or vent passage 46 extends into body 56 and opens into bore 56 between the passage 50 and inlet port 62. The axial spacing of passages 46 and 50 along bore 56 determines the distance or stroke traveled by the spool along the bore during normal operation of the engine. Normal open operational positions of valve 24 are shown in FIGS. 3 and 4. The normal closed operational position of the valve is shown in FIG. 5.

Figure 6:
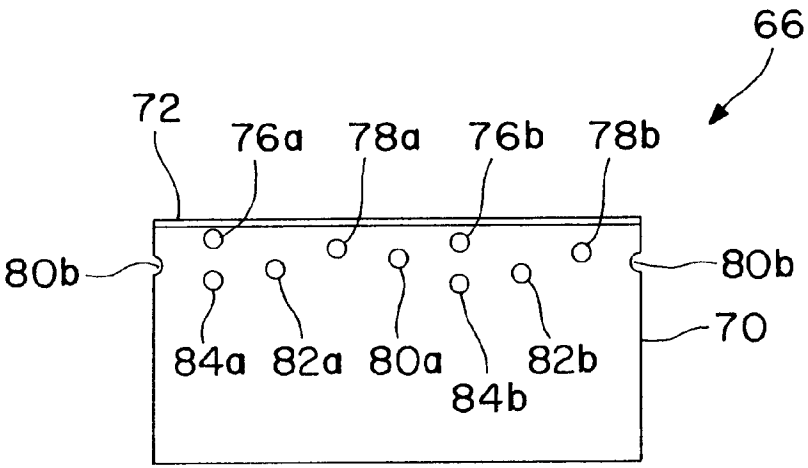
FIG. 6 is a view of the unwound exterior surface of the inlet throttle valve spool.

As illustrated in FIG. 6, inlet throttle valve spool 66 includes five pairs of diametrically opposed, axially offset circular flow control openings 76–84 extending through wall 70. The openings are positioned closely adjacent open spool end 72. FIGS. 2–5 do not illustrate all openings 76–84.

Each pair of openings 76–84 includes an opening identified by indicator "a" and an opening identified by indicator "b". The openings are spaced along the longitudinal axis of spool 66, and correspondingly along the longitudinal axis of bore 56, with the axial spacing between each pair of openings 76*a*–76*b*; 76*b*–78*a*; 78*a*–78*b*; 78*b*–80*a*; 80*a*–80*b*; 80*b*–82*a*; 82*a*–82*b*; 82*b*–84*a*; and 84*a*–84*b* equal to slightly more than one-fourth the diameter of the openings. This gradual shift of the openings with overlap along the length of the spool assures smooth increase and decrease of the area of the flow opening through the valve as the spool is moved between normal operational positions shown in FIGS. 3–5 of the drawings and the openings move past valving edge 75 of bore 56 at inlet port 62. The openings are spaced around the spool.

The pairs of diametrically opposed flow control openings in the spool with slight axial offset effectively balance radial pressure forces exerted on the spool to reduce binding or hysteresis in bore 56 during throttling movement of the spool along the bore. The inner surface 86 of the spool adjacent end 72 is undercut to prevent spring 74 from obstructing flow through openings 76–84.

Figure 2:
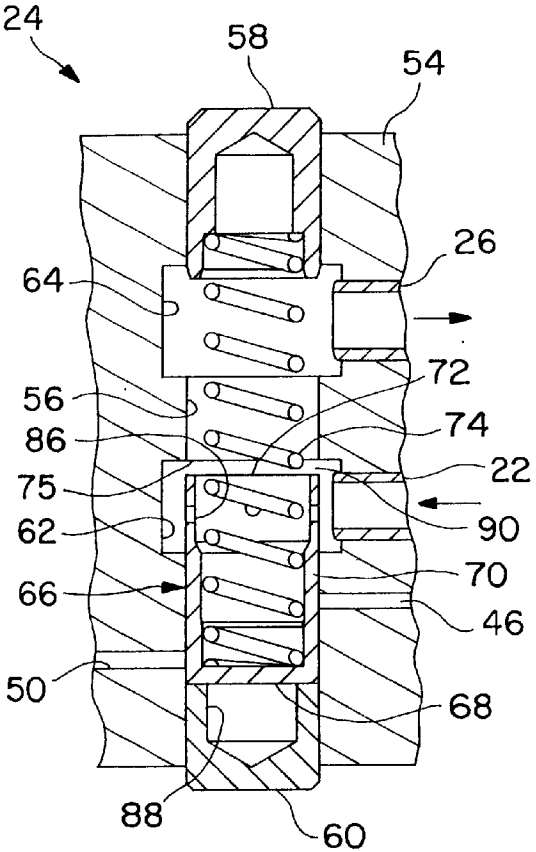

FIG. 2 illustrates the inlet valve in the fully open start position where spring 74 holds spool 66 against stop plug 60. The cylindrical wall 70 of the spool adjacent piston 68 extends past and closes pilot flow passage 50 to prevent direct pilot flow from the passage 50 to the space between the piston and the end of the bore, here pressure chamber 88 located in plug 60 below piston 68. The space need not extend into plug 60. During initial operation of the engine chamber 88 is normally filled with oil. Wall 70 also closes dump passage 46.

The sliding fit between the spool adjacent piston 68 and bore 56 and the spring-bias contact between the piston and the plug 60 permit slow, seepage flow of oil from passage 50 along the bore, across the top of the plug and into the space between the piston and plug. When the valve is in the fully open start position shown in FIG. 2 and the engine has been started slow seepage flow of oil from passage 50 to chamber 88 slowly moves the spool away from plug 60 toward the open operating position of FIG. 3.

When the spool is in the fully open start position of FIG. 2, the edge 72 at the open end of the spool 66 is withdrawn from valving edge 75 on the portion of bore 56 between the inlet and outlet ports 62 and 64. Edge 72 is located in port 62. All of the flow control openings 76–84 are also located in the inlet port 62. These openings and the large circular flow opening 90 between spool end 72 and bore valving edge 75 provide a large total flow area for low-pressure oil flowed through line 22, the inlet throttle valve and passage 26 to pump 12. The large flow area assures that during cranking, startup and warm up cold, viscous low-pressure engine oil from pump 16 is flowed to pump 12. When the engine is cranked for starting, pump 16 is rotated slowly and pumps oil at low-pressure and at a low flow rate. The large flow area of valve 24 during starting facilitates flow of this oil to the high-pressure pump 12 and assures sufficient high-pressure oil is provided to fire the injectors during starting of the engine.

When the spool 56 is in the fully open start position and is held against plug 60 by spring 74, open end 72 is located in the inlet port 62, a distance below edge 75. As shown in FIG. 2, the axial length of the spool, from piston 68 to end 72, is less than the axial distance from the stop surface on the end of plug 60 to edge 75. The plug serves as a stop to locate the spool following shutdown of the engine.

During warm up operation of the engine following starting, the inlet throttle valve is moved from the fully open start position shown in FIG. 2 to the open operating position of FIG. 3. Pressurized pilot flow oil from passage 50 seeps into chamber 88 to move the spool 66 slowly away from the plug 60 toward the open operating position shown in FIG. 3. In this position, the piston 68 has uncovered passage 50 to permit direct pilot flow from the passage into chamber 88. The open end or lip 72 of the spool has moved from the inlet port 62 past edge 75 and into bore 56, closing opening 90. Further direct flow of oil through passage 50 into chamber 88 moves the spool along bore 56 between normal operational positions as shown in FIGS. 3, 4 and 5. Opening 90 is open during starting and warm up and closes when the spool opens passage 50 to chamber 88 to commence normal operation of valve 24.

In the FIG. 3 position of valve 24 the axial length of the spool is substantially equal to the axial distance from the side of the flow passage 50 adjacent plug 60 to the side of the inlet port 62 away from plug 60. Movement of the spool from the FIG. 3 position away from plug 60 opens the flow passage 50 and closes the circular inlet opening 90 substantially simultaneously.

During normal operation of valve 24, the large area opening 90 is closed and all oil flowing to pump 12 from line 22 flows through available openings 76–84 in the spool. In the position shown in FIG. 3 all of the flow openings 76–84 open into the inlet port and flow oil into the spool and to the pump. The spool in located in the maximum flow or normal open operating position.

Flow of additional oil into chamber 88 moves the spool from the position of FIG. 3 to the position of FIG. 4 where a number of the flow control openings 76–84 adjacent spool end 72 have been moved out of the inlet port 62, past edge 75 and into bore 56, thus reducing the flow area for the valve and reducing the volume of oil flowed to pump 12. Flow of additional oil into chamber 88 moves the piston further away from plug 60 to move additional flow openings into bore 56 and further reduce the flow area of the valve and the flow of oil to pump 12.

When the spool is in the normal operating range of FIGS. 3–5, the instantaneous position of the spool along the bore is determined by a pressure balance between the pressure of the pilot oil in chamber 88 acting on piston 68 to move the spool in a closing direction and the force of spring 74 acting on the spool plus the hydraulic pressure of oil in the outlet port acting on the opposite side of the spool to move the spool in an opening direction. The hydraulic pressure of the oil in the outlet port is primarily the pressure of the oil in the inlet of pump 12, not the pressure of the oil supplied by low-pressure engine oil pump 16. The pressure of the oil from pump 16 may vary depending upon the volume of oil pumped and the speed of the engine but does not destabilize the spool.

During normal operation of the engine the spool moves between the positions shown in FIGS. 3–5. FIG. 3 illustrates the maximum normal open position of the spool during operation after startup. FIG. 5 illustrates the minimum normal closed position of the spool after startup.

In FIG. 5, oil from passage 50 has moved the spool toward the closed position sufficiently to open drain passage 46. Flow control passages 76–82 are located in bore 56 past edge 75 and closed. Openings 84 are located partially in bore 56 and partially in the inlet port 62, and are partially open. In this position, the valve 24 has a minimum flow area for flowing oil from low-pressure pump 16 to high-pressure pump 12. Flow of oil from chamber 88 into drain or vent passage 46 dumps bleed flow oil in chamber 88 to sump 18. The spool cannot move further in the closing direction. Pilot flow from the IPR valve drains directly to the sump. Restriction 52 is bypassed.

Opening of passage 46 provides a soft hydraulic stop limiting movement of the inlet throttle spool in the closing direction. The maximum position of the spool in the closed direction is determined hydraulically, without surface-to-surface engagement between the spool and a physical stop located in the path of closing movement of the spool. Elimination of mechanical engagement between the spool and a stop prevents mechanical injury to the spool and provides improved control over the motion of the spool. The hydraulic stop with direct dump of pilot flow improves IPR valve stability. Rapid discharge of an increased pilot flow into passage 50 prevents an undesirably large pressure increase in the passage and in the IPR valve. Such a pressure increase can adversely affect operation of the IPR valve.

The body 54, plugs 58 and 60, spring 74 and spool 66 are formed from suitable metal. Spool 66 has a lightweight metal construction with minimum mass. This construction facilitates rapid axial shifting and throttling of inlet flow when the spool is in the operating range shown in FIGS. 3–5. The spool shifts rapidly and assumes new pressure balance positions rapidly in response to changed pilot flow through passage 50. The mass of spool 66 is minimized by providing piston 68 at one end of the spool, without protrusions extending beyond the piston, by maintaining the total length of the spool short and by locating the flow control openings 76–84 immediately adjacent open spool end 72.

The stability of circuit 10 is a function of the size of bleed orifice 52. The orifice is designed to provide sufficient restriction to flow of bleed oil from valve 40 during normal high speed operation of the engine to maintain desired pressure in chamber 88 and rapid throttling movement of the spool 66 with rapid reestablishment of a pressure balance after the spool has moved in response to an altered signal from the IPR valve. Flow to pump 12 and the output pressure in passage 28 are changed rapidly.

When the engine control module rapidly decreases the current flow to solenoid 48, indicating a rapid reduction in the output pressure in passage 28, bleed flow through passage 50 increases. Orifice 52 restricts discharge flow to the sump and increases pressure in chamber 88 to shift the spool toward the fully closed position so that piston 68 opens dump passage 46. The increased bleed flow of oil is dumped directly to the sump. The pressure in passage 50 is rapidly reduced to prevent pressure interference with the operation of IPR pilot stage valve 40. The soft hydraulic stop feature of inlet throttle valve 24 rapidly reduces pressure build up in valve 40 and passage 50 to compensate for the inability of restriction 52 to handle the increased pilot flow. This permits the restriction to be properly sized for operation during the high RPM operating range of the engine while maintaining stability during rapid reduction in engine speed.

The operation of hydraulic circuit 10 will now be described.

After the operating engine is shut off, spring 74 of the inlet throttle valve biases the spool toward plug 60. While passage 50 is open, the spool flows oil in chamber 88 to the sump through passage 50 and restriction 52. When the spool closes passage 50, oil in chamber 88 seeps past the spool into passage 50 and, in time, permits the spring to move the spool to the fully open start position as shown in FIG. 2. During starting cranking of the engine the large flow area of fully open valve 24 permits maximum flow of low-pressure oil from pump 16 to pump 12.

After the engine fires, the spool 66 is retained in the fully open start position of FIG. 2 until pilot oil from passage 50 slowly seeps into chamber 88 to enlarge the chamber and move the piston away from the plug 60, move the upper spool end 72 into bore 56 closing flow passage 90, and open passage 50 to chamber 88. See FIG. 3. The spool is then in the normal operating range of FIGS. 3 to 5 and the position of the spool is determined by a pressure balance between the pressure of oil in chamber 88 exerted on piston 68 and the force of spring 74 and the liquid pressure in the inlet of pump 12 acting on the spool. The spool will move along passage 56 until an equilibrium position is reached and the flow area through openings 76–84 will vary depending upon the equilibrium position. The low mass spool rapidly responds to changes in the pressure in chamber 88.

The length of time required for seepage flow to shift the spool from the fully open position of FIG. 2 to the operating range may vary from thirty seconds to ten minutes, depending upon the rate of which oil seeps into the chamber 88. This time may be adjusted to provide a desired warm-up period for the engine, during which time flow of oil to the high-pressure pump is unrestricted. Holding the valve 24 open for an initial interval after startup facilitates warming up of the engine and can reduce combustion pollutants.

During normal operation of the warmed engine the spool responds stably to changed bleed flow through passage 50. When the spool is moved to the closed position of FIG. 5, the spool does not engage a mechanical stop. Rather, dump passage 46 is opened to permit the increased bleed flow to flow directly to the sump and prevent further movement of the spool, without undue pressure increase because of restriction 52 and without interference to the operation of valve 34.

When the engine is idling the output of low-pressure pump 16 may have a pressure as low as 10 PSI. This pressure varies considerably, primarily because of the low speed of operation of pump 16. This variation in inlet pressure supplied to valve 24 does not destabilize or move the spool in bore 56 because the pressure does not act directly on the spool. The spring side of the spool is connected to the inlet of high-pressure pump 12, not to the output of the low-pressure pump 16.

When the engine is shut down, the spring returns the spool to the fully open start position of FIG. 2.

While I have illustrated and described preferred embodiments of my invention, it is understood that this is capable of modification, and I therefore do not wish to be limited to the precise details set forth, but desire to avail myself of such changes and alterations as fall within the purview of the following claims.

What is claimed is:

1. In an internal combustion engine having a hydraulic circuit for supplying high-pressure liquid to hydraulically actuated, electronically controlled components, the circuit including a high-pressure pump to flow high-pressure liquid to the components, a source of low-pressure liquid and an inlet passage extending from the source of low-pressure liquid to the high-pressure pump, the improvement comprising:

an inlet throttle valve in the inlet passage, the valve including a cylindrical valving passage having opposed ends and a wall extending between such ends; an inlet port; an outlet port; both ports opening into said valving passage with one port located in said wall; a valve member located in and slideably moveable along the valving passage, the valve member including a piston facing one valving passage end and a hollow cylindrical body extending from the piston along the valving passage toward the other valving passage end; said cylindrical body moveable across said one port to vary the flow area for the valve; a spring in the valving passage biasing the valve member toward said one valving passage end; a bleed flow passage opening through said wall into the interior of the valving passage, said bleed flow passage located between said one port and said one valving passage end; and a chamber in the valving passage located between said piston and said one valving passage end, wherein said valve having a fully open position with said piston located between said bleed flow passage and said one valving passage end and said cylindrical body and one port defining a large inlet area, and said valve having an operational position with said piston located between said bleed flow passage and said one port to directly communicate the bleed flow passage and the chamber and with said cylindrical body partially obstructing said one port so that the flow area of the valve is reduced.

2. The improvement of claim 1 including a vent passage opening into the valving passage between said one port and said bleed flow passage.

3. The improvement of claim 1 wherein said one port comprises said inlet port.

4. The improvement of claim 3 wherein the inlet port surrounds the valving passage and including flow openings extending through the end of the cylindrical body away from the piston, said flow openings movable across the inlet port to vary the flow area.

5. In an internal combustion engine having a hydraulic circuit for supplying high-pressure liquid to hydraulically actuated, electronically controlled components, the circuit including a high-pressure pump to flow high-pressure liquid to the components, a source of low-pressure liquid and an inlet passage extending from the source of low-pressure liquid to the high-pressure pump, the improvement comprising:

an inlet throttle valve in the inlet passage, the valve including a valving passage having opposed ends and a wall extending between such ends; an inlet port opening through the wall into the valving passage; an outlet port opening into said valving passage; a valve member located in and slideably moveable along the valving passage, the valve member including a hydraulic pressure responsive piston facing one valving passage end and a body extending from the piston along the valving passage toward the other valving passage end; said body moveable across said inlet port to vary the flow area for the valve; a spring in the valving passage biasing the valve member toward a position allowing full communication between the said inlet port and the said outlet port, a chamber in the valving passage located between said piston and said one valving passage end; and a flow passage extending into said chamber, wherein the flow area of the valve is determined by a balance position of the valve member in the valving passage determined by the force of the spring and the pressure of the liquid at the outlet port biasing the valving member toward said one valving passage end and the pressure of the liquid in the chamber biasing the valving member toward said other valving passage end, said balance position determined substantially independently of the pressure of the liquid at the inlet port.

6. The improvement of claim 5 including a vent passage opening into the valving passage between the inlet port and the flow passage.

7. The improvement of claim 5 wherein the valve member body comprises a hollow cylinder and including a plurality of flow openings extending through the end of such body away from the piston, said inlet passage extending around the valving passage.

8. An inlet throttle valve for controlling the flow of liquid from a low-pressure liquid source to a high-pressure pump, the valve including a valve body; a valving passage in the valve body having a passage wall and opposed ends; an inlet port opening into the passage through the passage wall; an outlet port communicating with the interior of the valving passage and located to one side of the inlet port; a spool located in and movable along the passage, the spool including a hydraulic pressure responsive piston located to the other side of the inlet port and facing one valving passage end, and a valving member moveable across the inlet port to vary the flow area of the valve and control flow of low-pressure liquid through the valve and to the high-pressure pump; a spring biasing the spool toward a position allowing full communication between the said inlet port and the said outlet port; and hydraulic pressure means for biasing said piston towards a position of reduced communication between the said inlet port and the said outlet port proportional to desired flow of low-pressure fluid through the valve, wherein the flow area at the valve is determined by a pressure balance position of the spool in the passage made substantially independently of the pressure at the low-pressure source.

9. The inlet throttle valve as in claim 8 wherein the spool includes an edge cooperable with the inlet port to vary the flow area.

10. The inlet throttle valve as in claim 9 wherein the edge extends around the spool, and including a circular inlet opening at the edge when the valve is in a fully open position.

11. The inlet throttle valve as in claim 8 wherein the spool and inlet port include one or more openings and an edge relatively moveable across said openings.

12. The inlet throttle valve as in claim 11 wherein said openings are in said spool.

13. The inlet throttle valve as in claim 8 wherein said valving passage is cylindrical and the spool has a hollow cylindrical body with said piston at one end of the body.

14. The inlet throttle valve as in claim 13 wherein said spool comprises a valving edge at the other end of the cylindrical body.

15. The inlet throttle valve as in claim 13 wherein said spool comprises a plurality of openings extending through the spool.

16. The inlet throttle valve as in claim 15 wherein said inlet port surrounds the valving passage and said openings include a plurality of diametrically opposed, axially offset openings.

17. The inlet throttle valve as in claim 8 including a chamber between said piston and said one end of the valving passage, a flow passage opening into said valving passage between the inlet port and said one valving passage end, said valve having a fully open position with said piston located between said flow passage and said one valving passage end and an operating position with said piston located between said flow passage and said inlet port.

18. The inlet throttle valve as in claim 17 including a seepage flow connection between said flow passage and said chamber when the valve is in the fully open position.

19. The inlet throttle valve as in claim 17 including a circular inlet opening at the inlet port when said valve is in said fully open position.

20. The inlet throttle valve as in claim 19 wherein the axial length of the spool along the wall is substantially equal to the distance from the side of the flow passage adjacent said one valving passage end to the side of the inlet port away from said one valving passage end wherein movement of the spool from the fully open position away from said one valving passage end opens the flow passage and closes the circular inlet opening substantially simultaneously.

21. The inlet throttle valve as in claim 8 including a chamber in the valving passage between the piston and said one valving passage end; a flow passage opening into the chamber; and a vent passage opening into the chamber between the inlet port and the flow passage to limit movement of the spool away from said one valving passage end.

22. The inlet throttle valve as in claim 8 including a vent passage opening into the valving passage between the inlet port and said one valving passage end.

23. An inlet throttle valve for controlling the flow of liquid from a low-pressure liquid source to a high-pressure pump, the valve including a valve body; a valving passage in the valve body having a passage wall and opposed ends; an inlet port communicating with the valving passage; an outlet port communicating with the valving passage, one of said ports opening through said wall; a spool located in and movable along the passage, the spool including a hydraulic pressure responsive piston facing one end of the passage, and a valving member moveable across said one port to vary the flow area of the valve and control flow of low-pressure liquid through the valve and to the high-pressure pump; a spring biasing the spool toward said one valving passage end; a chamber between said piston and said one valving passage end; and a flow passage opening into said valving passage between said one port and said one valving passage end, the valve having a fully open position wherein said piston is located between the flow passage and said one valving passage end and an operational position where said piston is located between the flow passage and said one port, wherein when the valve is in the fully open position liquid from the flow passage bleed flows past the piston and into the chamber to move the spool away from said one valving passage end to an operating position.

24. The inlet throttle valve as in claim 23 wherein the spool includes a valving edge cooperable with said one port to vary the flow area of the valve.

25. The inlet throttle valve as in claim 24 wherein the valving edge extends around the spool, and including a circular inlet opening at the edge when the valve is in the fully open position.

26. The inlet throttle valve as in claim 25 wherein the spool and said one port include one or more flow openings and a portion relatively moveable across said openings.

27. The inlet throttle valve as in claim 26 wherein said openings are in the spool.

28. The inlet throttle valve as in claim 23 wherein said one port comprises said inlet port.

29. The inlet throttle valve as in claim 23 including a seepage flow connection between said flow passage and said chamber when the valve is in the fully open position wherein seepage flow into the chamber slowly moves the valve from the fully open position to the operational position.

30. The inlet throttle valve as in claim 23 including a vent passage opening into the valving passage between said one port and the flow passage to limit movement of the spool away from said one end of the valving passage.

31. An inlet throttle valve for controlling the flow of liquid from a low-pressure liquid source to a high-pressure pump, the valve including a valve body; a valving passage in the valve body having a passage wall and opposed ends; an inlet port communicating with the valving passage; an outlet port communicating with the valving passage; one of said ports opening through said wall; a spool located in and moveable along the passage, the spool including a hydraulic pressure responsive piston facing one end of the passage and a valving member moveable across said one port to vary the flow area of the valve and control flow of low-pressure liquid through the valve and to the high-pressure pump; a spring biasing the spool toward said one valving passage end; a hydraulic fluid chamber located in said valving passage between said piston and said one valving passage end; an inlet flow passage opening into said valving passage adjacent said one valving passage end thereof; and a vent passage opening into said valving passage between said inlet flow passage and said one port to limit movement of the spool away from said one valving passage end.

32. The inlet throttle valve as in claim 31 wherein said piston having a position between said inlet flow passage and said one valving passage end wherein bleed flow from said inlet passage to said chamber slowly moves the piston away from said one valving passage to open said inlet flow passage to said chamber.

33. The inlet throttle valve as in claim 32 wherein said valve has a fully open position and an operating position, and including a circular inlet passage surrounding said wall when the valve is in said fully open position.

* * * * *